US010031434B2

(12) United States Patent
Takii et al.

(10) Patent No.: US 10,031,434 B2
(45) Date of Patent: Jul. 24, 2018

(54) CARRIER AND DEVELOPER

(71) Applicants: Mariko Takii, Kanagawa (JP); Yoshihiro Murasawa, Shizuoka (JP); Takahiro Nakamura, Shizuoka (JP); Kei Niwayama, Shizuoka (JP); Haruki Murata, Kanagawa (JP); Masato Taikoji, Shizuoka (JP); Koichi Sakata, Shizuoka (JP)

(72) Inventors: Mariko Takii, Kanagawa (JP); Yoshihiro Murasawa, Shizuoka (JP); Takahiro Nakamura, Shizuoka (JP); Kei Niwayama, Shizuoka (JP); Haruki Murata, Kanagawa (JP); Masato Taikoji, Shizuoka (JP); Koichi Sakata, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 8 days.

(21) Appl. No.: 15/160,590

(22) Filed: May 20, 2016

(65) Prior Publication Data

US 2016/0363880 A1 Dec. 15, 2016

(30) Foreign Application Priority Data

Jun. 12, 2015 (JP) ..... 2015-119223

(51) Int. Cl.
*G03G 9/113* (2006.01)
*G03G 9/107* (2006.01)
*G03G 15/08* (2006.01)

(52) U.S. Cl.
CPC ..... *G03G 9/1139* (2013.01); *G03G 9/1075* (2013.01); *G03G 9/1133* (2013.01); *G03G 15/08* (2013.01)

(58) Field of Classification Search
CPC .... G03G 9/1139; G03G 9/113; G03G 9/1075; G03G 9/1133
USPC ..... 430/111.35, 111.32
See application file for complete search history.

(56) References Cited

U.S. PATENT DOCUMENTS 7,553,598 B2 * 6/2009 Suzuki ..... G03G 9/10 430/111.1
2004/0229143 A1 11/2004 Umemura et al.
2005/0026064 A1 2/2005 Sugiura et al.
2005/0089786 A1 4/2005 Sugiura et al.
2005/0089787 A1 4/2005 Uchinokura et al.
2005/0191575 A1 9/2005 Sugiura et al.
2005/0208408 A1 9/2005 Uchinokura et al.
2005/0208411 A1 9/2005 Nakayama et al.
2006/0024606 A1 2/2006 Suzuki et al.
2006/0029433 A1 2/2006 Saito et al.
2006/0040194 A1 2/2006 Sugiura et al.
2006/0063081 A1 3/2006 Nagatomo et al.
2006/0068313 A1 3/2006 Nakayama et al.
2006/0204883 A1 9/2006 Nakayama et al.
2006/0240351 A1 10/2006 Sugiura et al.
2007/0031748 A1 2/2007 Kotsugai et al.
2007/0190444 A1 8/2007 Kotsugai et al.
2007/0275318 A1 11/2007 Sugiura et al.
2008/0014527 A1 1/2008 Kotsugai et al.
2008/0063433 A1 3/2008 Miyamoto et al.
2008/0181670 A1 7/2008 Tsuda et al.
2008/0267668 A1 10/2008 Sakata et al.
2008/0268366 A1 10/2008 Nakayama et al.
2008/0317508 A1 12/2008 Terai et al.
2009/0074473 A1 3/2009 Takahashi et al.
2009/0103943 A1 4/2009 Sakata
2009/0232532 A1 9/2009 Sakata et al.
2010/0068645 A1 3/2010 Iwatsuki et al.
2010/0233613 A1 9/2010 Masuda et al.
2010/0239975 A1 9/2010 Yamaguchi et al.
2011/0065037 A1 3/2011 Iwatsuki et al.
2011/0086307 A1 4/2011 Nakajima et al.
2011/0091802 A1 4/2011 Takahashi et al.
2011/0171573 A1 7/2011 Sakata et al.
2011/0217649 A1 9/2011 Masuda et al.
2011/0229817 A1 9/2011 Yamada et al.
2012/0008979 A1 1/2012 Suzuki et al.
2012/0028183 A1 2/2012 Nakajima et al.
2012/0057898 A1 3/2012 Sakata et al.
2012/0058423 A1 3/2012 Yamaguchi et al.
2012/0064451 A1 3/2012 Kishida et al.
2012/0230725 A1 9/2012 Sakata et al.
2012/0264042 A1 10/2012 Taikoji et al.
2012/0315572 A1 12/2012 Mizutani et al.
2013/0004209 A1 1/2013 Kishida et al.
2013/0016999 A1 1/2013 Tohmatsu et al.
2013/0065175 A1 3/2013 Sakata et al.
2013/0244162 A1 9/2013 Yamada et al.
2013/0252160 A1 9/2013 Nagayama et al.
2013/0252169 A1 9/2013 Yaguchi et al.
2013/0260299 A1 10/2013 Nakajima et al.
2013/0260302 A1 10/2013 Nakajima et al.
2013/0260307 A1 10/2013 Nagayama et al.
2014/0072910 A1 3/2014 Iwatsuki et al.
(Continued)

FOREIGN PATENT DOCUMENTS

JP 7-286078 10/1995
JP 11-184167 7/1999
(Continued)

OTHER PUBLICATIONS

Diamond, A.S. ed., et al., Handbook of Imaging Materials, second edition, Marcel Dekker, Inc., NY (2002), pp. 146-148.*
(Continued)

*Primary Examiner* — Janis L Dote
(74) *Attorney, Agent, or Firm* — Oblon, McClelland, Maier & Neustadt, L.L.P.

(57) ABSTRACT

A carrier includes a resin layer including Al and Sn and covering the surface of the carrier. A detectable amount of Al is from 1.0% to 12.1% by atom and a ratio (Al/Sn) of the detectable amount of Al to that of Sn is from 2.0 to 50.0 when the carrier is subjected to an X-ray photoelectron spectroscopic (XPS) analysis.

14 Claims, 1 Drawing Sheet

(56) References Cited

U.S. PATENT DOCUMENTS

| | | | |
|---|---|---|---|
| 2014/0080052 | A1 | 3/2014 | Yaguchi et al. |
| 2014/0227638 | A1 | 8/2014 | Kishida et al. |
| 2014/0248557 | A1 | 9/2014 | Yaguchi et al. |
| 2014/0255840 | A1 | 9/2014 | Sekiguchi et al. |
| 2014/0348550 | A1 | 11/2014 | Nagayama et al. |
| 2014/0348552 | A1 | 11/2014 | Iwatsuki et al. |
| 2015/0153665 | A1 | 6/2015 | Kishida et al. |

FOREIGN PATENT DOCUMENTS

| | | |
|---|---|---|
| JP | 11-202560 | 7/1999 |
| JP | 2006-039357 | 2/2006 |
| JP | 2010-117519 | 5/2010 |
| JP | 2011-145397 | 7/2011 |

OTHER PUBLICATIONS

Grant, R., et al.,ed., Grant & Hackh's Chemical Dictionary, fifth edition, McGraw-Hill Book Company, NY (1987), p. 445.*

* cited by examiner

CARRIER AND DEVELOPER

CROSS-REFERENCE TO RELATED APPLICATIONS

This patent application is based on and claims priority pursuant to 35 U.S.C. § 119 to Japanese Patent Application No. 2015-119223, filed on Jun. 12, 2015, in the Japan Patent Office, the entire disclosure of which is hereby incorporated by reference herein.

BACKGROUND

Technical Field

The present invention relates to a carrier for forming images, and a developer including the carrier.

Description of the Related Art

Electrophotographic image forming methods include forming an electrostatic latent image on an image bearer such as a photoconductive material, transferring a charged toner thereto to form a visible image (toner image), transferring the toner image onto a recording medium such as paper, and fixing the toner image thereon to form a final output image. Recently, electrophotographic copiers and printers are rapidly developing from monochrome to full-color, and full-color markets are expanding.

Full-color image forming apparatuses are becoming oil-less for the purpose of being downsized and simplified as well as monochrome image forming apparatuses. However, as mentioned above, to improve color reproducibility of a color toner, the color toner needs to have lower viscoelasticity because the fixed color toner image is required to have a smooth surface. Therefore, the color toner has offset problems more often than the monochrome toner does, making it more difficult to make a fixer oilless or use only a small amount of oil. In addition, a toner including a release agent has higher adherence to an image bearer and lower transferability to a transfer paper. Further, the release agent therein contaminates friction-charged members such as a carrier and lowers the chargeability thereof, resulting in deterioration of durability of the toner.

On the other hand, for the purpose of preventing toner constituents from filming, making the surface thereof uniform, preventing oxidization thereof, preventing deterioration of moisture sensitivity thereof, extending lives of developers, preventing adherence of the carriers to the surfaces of photoconductors, protecting photoconductors from being damaged or abraded by the carriers, controlling charge polarity thereof and controlling charge quantity thereof, a resin including carbon black is applied on the carrier core material to form a coating layer thereon. However, although quality images are produced initially, image quality may deteriorate because the coating layer is abraded as the number of images produced increases. Further, when the coating layer is abraded or the carbon black releases therefrom, color stains may occur. Instead of the carbon black, titanium oxide or zinc oxide can be used, but does not decrease volume resistivity sufficiently.

A toner tends to have low-temperature fixability to decrease power consumption. Further, printing speed is constantly increasing, and therefore a phenomenon known as toner spent on carrier more easily occurs. In addition, a toner tends to include many additives to produce images having higher quality, which increase toner spent, resulting in lowering the toner charge, toner scattering, and background fouling.

An expanding commercial printing market, i.e., a field of production printing needs higher quality images. It is quite difficult for a machine only to technologically suppress variation or uneven image density in an image and image density variation among ten thousands of images produced. Therefore, a toner is more required to have a constant charge quantity.

SUMMARY

A carrier includes a resin layer including Al and Sn and covering the surface of the carrier. A detectable amount of Al is from 1.0% to 12.1% by atom and a ratio (Al/Sn) of the detectable amount of Al to that of Sn is from 2.0 to 50.0 when the carrier is subjected to an X-ray photoelectron spectroscopic (XPS) analysis.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
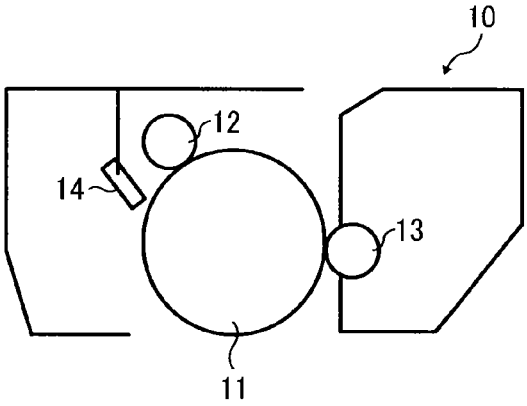
FIG. 1 is a schematic view illustrating an embodiment of the process cartridge of the present invention.
Figure 2A:
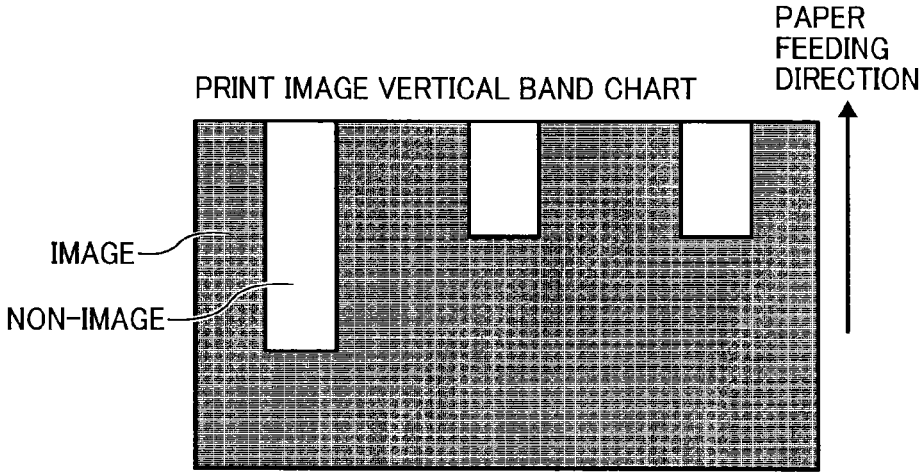
FIG. 2A is a view illustrating a vertical band chart used for evaluating ghost images.
Figure 2B:
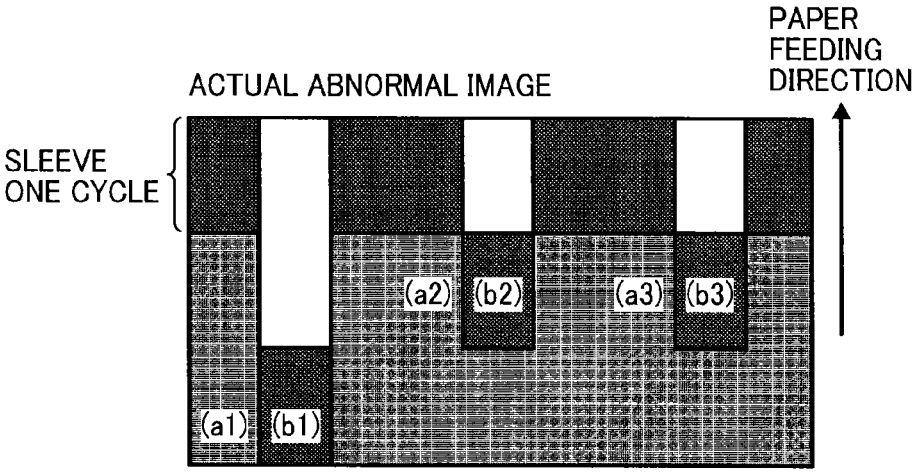
FIG. 2B is a view illustrating a difference of image density for one cycle (a) and after one cycle (b) of a sleeve when copying.

There is a need for providing a carrier for use in electrophotographic methods and electrostatic recording methods, capable of fully controlling charging for image quality required in a production printing field; having less resistance variation and less charge variation due to spent of toner compositions; free of contamination in image forming apparatuses due to image density variation, background fouling and toner scattering; and capable of feeding a stable amount of a developer to a developing area and continuously producing images having low image areal ratio at a printing density thereof even in high speed image forming apparatuses using low-temperature fixable toners.

(Carrier)

The carrier of the present disclosure includes a resin layer. Preferably, the carrier of the present invention is formed of a core particle and a resin layer covering the core particle.

The resin layer includes at least Al and Sn, and preferably includes Al fine particles and Sn fine particles.

A detectable amount of Al is from 1.0% to 12.1% by atom and a ratio (Al/Sn) of the detectable amount of Al to that of Sn is from 2.0 to 50.0 when the carrier of the present invention is subjected to an X-ray photoelectron spectroscopic (XPS) analysis.

The carrier of the present invention satisfying the above requirements is capable of fully controlling charging for desired image quality required, feeding a stable amount of a developer to a developing area and continuously producing images having low image areal ratio at a printing density thereof even in high speed image forming apparatuses using low-temperature fixable toners.

Al can keep a carrier positively charged even after producing images having high image area for a long time while a toner is negatively charged. Even when the positively-charged Al causes a toner spent on the carrier resin layer, the Al component exposed at the surface of the resin layer is thought to suppress the carrier from lowering chargeability.

In order to suppress charge lowering, an exposure amount of Al on the surface of the carrier, i.e., the detectable amount of Al is preferably from 1.0% to 12.1% by atom when the carrier is subjected to XPS analysis. When greater than 12.1% by atom, the content of Al is so high that Al is easily released from the resin layer, resulting in deterioration of charge stability and resistance stability as time passes.

In addition, the detectable amount of Al on the surface of the carrier when subjected to XPS analysis after images having a high image area are produced for a long time is preferably from 4.0% to 20.0% by atom.

"after images having a high image area are produced for a long time" means when 100,000 images each having an image area of 80% are produced by an image forming apparatus, a digital color copier and printer Pro C901 from Ricoh Company, Ltd. with a developer having a toner concentration of 7%. After 100,000 images are produced, the developer is collected from the image forming apparatus, and a toner is removed from the developer to leave the carrier. This is equivalent to a case where the carrier and a toner are mixed at 30° C. and 90% RH to obtain a developer including the toner in an amount of 20% by mass, and the developer is stirred at 500 rpm for 2 hrs. The developer may be collected after stirred and the toner may be removed from the developer to leave the carrier.

When the detectable amount of Al before images having a high image area are produced for a long time is less than 1.0% by atom or the detectable amount of Al after images having a high image area are produced for a long time is less than 4.0% by atom, the carrier is charged less due to deterioration as it is used and the developer decreases in chargeability, resulting in image quality problems such as toner scattering and background fouling.

When the detectable amount of Al after images having a high image area are produced for a long time is greater than 20.0% by atom, the content of Al is so high that Al is easily released from the resin layer, resulting in deterioration of charge stability and resistance stability as time passes.

In the present invention, the detectable amount of Al before images having a high image area are produced for a long time is more preferably from 4.0% to 12.1% by atom.

Further, in the present invention, the detectable amount of Al after images having a high image area are produced for a long time is more preferably from 9.5% to 20.0% by atom.

Sn is essentially assures the resistance of the carrier. In the present invention, fine particles including Sn are preferably used to control a volume resistivity of the carrier. However, when Sn is included too much, the carrier is difficult to keep chargeability after images having a high image area are produced for a long time. It is thought this is because Sn has chargeability close to a polarity of the toner and is unable to suppress charge lowering as Al.

From the viewpoint of suppressing lowering of chargeability after images having a high image area are produced and assuring a volume resistivity of the carrier, a ratio (Al/Sn) of the detectable amount of Al to that of Sn is from 2.0 to 50.0, and preferably from 3.7 to 11.0 when the carrier is subjected to an XPS analysis.

When the a ratio (Al/Sn) of the detectable amount of Al to that of Sn before images having a high image area are produced for a long time is less than 2.0 or a ratio (Al/Sn) of the detectable amount of Al to that of Sn after images having a high image area are produced for a long time is less than 3.7, Al exposed on the surface of the carrier is less than Sn and the carrier is charged less due to deterioration as it is used and the developer decreases in chargeability, resulting in image quality problems such as toner scattering and background fouling.

When the a ratio (Al/Sn) of the detectable amount of Al to that of Sn before images having a high image area are produced for a long time is greater than 50.0 or a ratio (Al/Sn) of the detectable amount of Al to that of Sn after images having a high image area are produced for a long time is greater than 11.0, Al is more than Sn and resistance stability is not assured.

The ratio (Al/Sn) of the detectable amount of Al to that of Sn before images having a high image area are produced for a long time is from more preferably from 4.3 to 50.0 when the carrier is subjected to an XPS analysis.

The ratio (Al/Sn) of the detectable amount of Al to that of Sn after the developer stirred, i.e., after images having a high image area are produced for a long time is from more preferably from 5.0 to 11.0 when the carrier is subjected to an XPS analysis.

<Resin Layer>

The resin layer includes a resin, Al and Sn. Al and Sn are preferably fine particles. Besides the Al and Sn fine particles, the resin layer may include various electroconductive fine particles, and may further include a silane coupling agent to improve stability and durability of a carrier as time passes.

The resin layer preferably has no damage and an average thickness of from 0.30 to 0.90 μm.

When not less than 0.30 the resin layer is not easily broken or abraded. When not greater than 0.90 the carrier does not adhere to images because the resin layer has no magnetization, and the resistance is effectively controlled.

<<Al and Sn Fine Particles>>

The resin layer of the carrier preferably includes the Al fine particles in an amount of from 12% to 76% by mass, and more preferably from 52% to 76% by mass based on total mass of the resin included in the resin layer.

The content of the Al fine particles is represented by a ratio (% by mass) of the Al fine particles to a total of all solid contents and the Al fine particles included in the resin layer.

When the resin layer includes the Al fine particles in an amount of from 12% to 76° by mass, the carrier is assured to have chargeability after images having a high image area are produced for a long time. In addition. Al is dispersed in the resin layer to strengthen the resin layer and decrease abrasion thereof. Therefore, bulk density variation due to spent and abrasion occurs less, and stable developability is assured for long periods. Particularly when not less than 52% by mass, Al is sufficiently exposed on the surface of the carrier to suppress the carrier from lowering charge due to deterioration as it is used, and the developer from decreasing in chargeability, which causes image quality problems such as toner scattering and background fouling. In addition, the carrier sufficiently has concave areas on the surface to keep constant chargeability in toner spent, prevent the resin layer from abrading due to lowering of density of fine particles in the resin layer, and prevent carrier adherence due to bulk density variation, charge lowering and exposition of the core particle.

The content of the Sn fine particles in the resin layer of the carrier may be decided in consideration of a balance with the content of the Al fine particles. The content of the Sn fine particles is represented by a ratio (% by mass) of the Sn fine particles to a total of all solid contents and the Sn fine particles included in the resin layer.

In the present invention, a total amount of the fine particles included in the resin layer is preferably not greater than 110% by mass based on total mass of the resin to effectively prevent too many fine particles from releasing and the carrier from adhering to the exposed core particle.

Specific examples of the Al and Sn fine particles include, but are not limited to, aluminum oxide, and tin oxide and PTO (tin oxide doped with phosphorus), respectively.

The fine particles preferably have a powder specific resistance of from 2 to 15 Ω·cm to effectively prevent the resin layer of the carrier from lowering strength to be fragile when the content of the fine particles is low, and the fine particles from releasing when the content thereof is too high. The powder specific resistance of fine particles can be measured by. e.g., a LCR meter from Yokogawa Hewlett-Packard, Ltd.

<<Resin>>

Specific examples of the resin include, but are not limited to, a resin obtained by heating a copolymer including the following monomer A component (A component) and monomer B component (B component). Preferably a resin obtained by coating a radically copolymerized acrylic copolymer including the A component and the B component on a core particle, and heating coated core particle.

[A component]

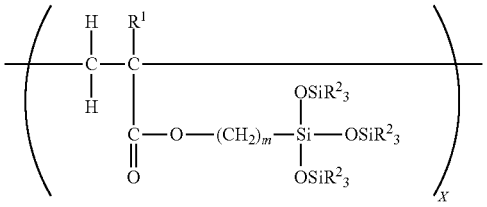

[B component (crosslinked component)]

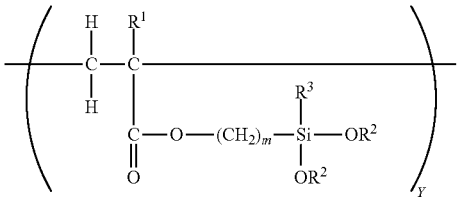

wherein $R^1$ represents a hydrogen atom or a methyl group; m represents an integer of from 1 to 8, and therefore $(CH_2)_m$ represents an alkylene group such as methylene groups, ethylene groups propylene groups and butylene groups having 1 to 8 carbon atoms; $R^2$ represents an alkyl group such as methyl groups, ethyl groups, propyl groups, isopropyl groups and butyl groups having 1 to 4 carbon atoms; $R^3$ represents an alkyl group such as methyl groups, propyl groups, isopropyl groups and butyl groups having 1 to 8 carbon atoms or alkoxy groups such as methoxy groups, ethoxy groups, propoxy groups and butoxy groups having 1 to 4 carbon atoms; X is from 10% to 90% by mol, preferably from 10% to 40% by mol, and more preferably from 20% to 30% by mol; and Y is from 10% to 90% by mol, preferably from 10% to 80% by mol, and more preferably from 15% to 70% by mol The A component has an atomic group tris(trimethylsiloxy)silane having a side chain in which many methyl groups are present. When a ratio of the A component is high relative to the total resin, the toner has small surface energy and resin components and waxes adhere less. When less than 10% by mol, the toner components increases. When greater than 90% by mol, the component B decreases and the resin layer is not well crosslinked, resulting in insufficient toughness, adhesiveness between the core material and the resin layer and durability thereof.

$R^2$ represents an alkyl group having 1 to 4 carbon atoms in the formula (1). Such A component includes tris(trialkylsiloxy) silane compounds having the following formulae:

$CH_2{=}CMe\text{-}COO{-}C_3H_6{-}Si(OSiMe_3)_3$ $CH_2{=}CH{-}COO{-}C_3H_6{-}Si(OSiMe_3)_3$ $CH_2{=}CMe\text{-}COO{-}C_4H_8{-}Si(OSiMe_3)_3$ $CH_2{=}CMe\text{-}COO{-}C_3H_6{-}Si(OSiEt_3)_3$ $CH_2{=}CH{-}COO{-}C_3H_6{-}Si(OSiEt_3)_3$ $CH_2{=}CMe\text{-}COO{-}C_4H_8{-}Si(OSiEt_3)_3$ $CH_2{=}CMe\text{-}COO{-}C_3H_6{-}Si(OSiPr_3)_3$ $CH_2{=}CH{-}COO{-}C_3H_6{-}Si(OSiPr_3)_3$ $CH_2{=}CMe\text{-}COO{-}C_4H_8{-}Si(OSiPr_3)_3$ wherein Me represents a methyl group; Et represents an ethyl group and Pr represents a propyl group.

Methods of preparing the A component are not particularly limited, and a method of reacting tris(trialkylsiloxy) silane with allyl acrylate or allyl methacrylate under the presence of a platinum catalyst, a method of reacting methacryloxy alkyl trialkoxy silane with hexaalkyldisiloxane under the presence of a carboxylic acid and an acid catalyst, disclosed in Japanese published unexamined application No. JP-H11-217389-A, etc. can be used.

The B component is a radically polymerizable di- or trifunctional silane compound. When less than 10% by mol, the coated layer has a few crosslinked points and does not have enough toughness. When greater than 90% by mol, the coated layer is hard and fragile, and easy to abrade. Further, hydrolyzed crosslinking components remaining in a large amount as a silanol group are thought to deteriorate moisture resistance of the coated layer.

Specific examples of the B component include 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane and 3-acryloxypropyltri(isopropoxy)silane.

As a technique enhancing durability by crosslink of coating, there is one described in Japanese Patent No. JP-3691115-B2 (Japanese published unexamined application No. JP-H08-305090-A). Namely, in regard to the one described in Japanese Patent No. JP-3691115-B2 (Japanese published unexamined application No. JP-H08-305090-A) specification, it is a carrier for an electrostatic image development characterized by coating the surface of magnetic particle with a thermosetting resin that a copolymer of an organopolysiloxane having at least a vinyl group at the end and a radical copolymerizable monomer having at least one functional group selected from the group consisting of hydroxyl group, amino group, amide group and imide group is cross-linked by an isocyanate compound, but the actual situation is that no sufficient durability on peeling and scraping of coating is obtained.

Although the reason has been not cleared sufficiently, in the case of thermosetting resin that the foregoing copolymer is cross-linked by an isocyanate compound, as is known from the structural formula, functional groups (active hydrogen-containing groups) per unit weight reacting (cross-linking) an isocyanate compound in a copolymer resin are too few to form a two-dimensionally or three-dimensionally dense crosslink structure at a crosslink point. Therefore, it is inferred that in a prolonged use, peeling and scraping of coating occur easily (abrasion resistance of coating is poor), so a sufficient durability is not obtained.

When peeling and scraping of coating occur, change of image quality due to the lowering of carrier resistance and carrier adhesion take place. Peeling and scraping of coating deteriorates flow properties of developer, leading to the lowering of amount scooped, and causing the lowering of image concentration, background fouling due to TC up, and scattering of toner.

The resin layer of the present invention preferably includes a resin obtained by heating the radically copolymerized acrylic copolymer including the A component and the B component.

The resin used in the present invention is a copolymer resin having a lot of functional groups (points) capable of cross-linking being difunctional or trifunctional per resin unit weight (per unit weight, as many as 2 to 3 times), and this is further cross-linked by condensation polymerization, hence it is thought that coating is very tough and hardly scraped, leading to high durability.

Compared with crosslink by an isocyanate compound disclosed in Japanese Patent No. JP-3691115-B1 (Japanese published unexamined application No. JP-H08-305090-A), crosslink by siloxane bond in the present invention is larger in bond energy and more stable to heat stress, hence it is inferred that stability of coating with time is maintained.

In the present invention, it is preferable the monomer A component and the monomer B component are radically copolymerized to obtain the following copolymer, the copolymer is hydrolyzed to form a silanol group, and the silanol group is condensed with a catalyst to obtain a crosslinked material, the crosslinked material is coated on a core particle and heated to form a resin layer.

wherein $R^1$, m, $R^2$ and $R^3$ are the same as the above; X is from 10% to 40% by mol; Y is from 10% to 40%; Z is from 30% to 80% by mol, and preferably from 35% to 75% by mol; and Y+Z is greater than 60% by mol and less than 90% by mol, and preferably greater than 70% by mol and less than 85% by mol.

The C component has the following formula.

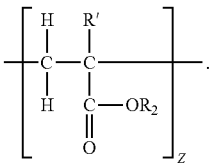

wherein $R^1$ and $R^2$ are the same as the above.

The C component imparts flexibility to the resin layer, and improves adhesiveness between the core particle and the resin layer, and the resin layer and the fine particles. When the C component is not less than 30% by mol, the adhesiveness is sufficient. When not greater than 80% by mol, the A component or the B component is not less than 10% by mol, and the resin layer has repellency, hardness and flexibility.

As the C component, acrylate and methacrylate are preferably used, specifically including methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino)ethyl methacrylate and 2-(diethylamino)ethyl acrylate.

Among these, alkyl methacrylate is preferably used, and methyl methacrylate is more preferably used. These compounds may be used alone or in combination.

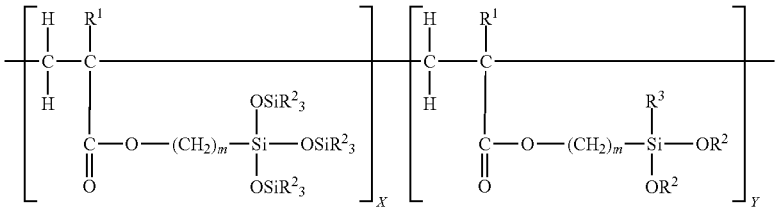

wherein $R^1$, m, $R^2$, $R^3$, X and Y are the same as the above.

In the present invention, an acrylic compound (monomer) may be added to the A and B components as a monomer C component (C component) such as a copolymer having the following formula.

The copolymer is an acrylic copolymer obtained by radically copolymerizing each of the monomers including the A component and the B component. In addition to having many crosslinkable functional groups per resin unit weight, the copolymer includes the crosslinkable B component

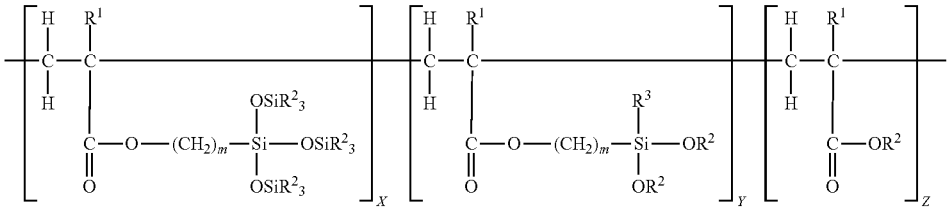

polycondensed with heat and crosslinked thereto. Therefore, the resin layer is thought to have high durability, i.e., quite tough and difficult to abrade.

Further, compared with crosslink by an isocyanate compound disclosed in Japanese Patent No. JP-3691115-B1 (Japanese published unexamined application No. JP-H08-305090-A), crosslink by siloxane bond in the present invention is larger in bond energy and more stable to heat stress, hence it is inferred that stability of coating with time is maintained.

The resin layer of the present invention preferably includes a silicone resin having a silanol group and for a functional group capable of producing a silanol group by hydrolysis. The silicone resin having a silanol group and for a functional group capable of producing a silanol group by hydrolysis (e.g., alkoxy groups and anionic groups such as halogeno groups bonded with Si atom) can condensation polymerize directly with a crosslinked component B of a copolymer mentioned later or with a crosslinked component B which is changed to a silanol group. The copolymer including the silicone resin further improves toner spent.

The silicone resin having a silanol group and/or a functional group capable of producing a silanol group by hydrolysis preferably includes at least one of repeat units having the following formulae (I):

(I)

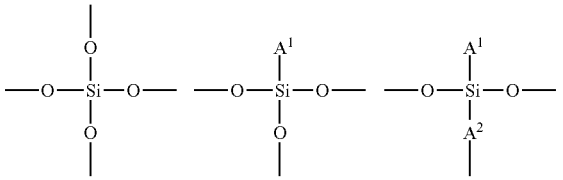

wherein $A^1$ represents a hydrogen atom, a hydroxy group, a methoxy group, a lower alkyl group having 1 to 4 carbon atoms or an aryl group such as a phenyl group and a tolyl group; $A^2$ represents an alkylene group having 1 to 4 carbon atoms or an arylene groups such as a phenylene group.

The aryl group in the formulae (I) preferably has 6 to 20, and more preferably 6 to 14 carbon atoms. The aryl group includes aryl groups from condensed polycyclic aromatic hydrocarbons such as naphthalene, phenanthrene and anthracene; aryl groups from chained polycyclic aromatic hydrocarbons such as biphenyl and terphenyl; besides aryl (phenyl) groups from benzene. Various substituents may be bonded with the aryl group.

The arylene group preferably has 6 to 20, and more preferably 6 to 14 carbon atoms. The arylene group includes arylene groups from condensed polycyclic aromatic hydrocarbons such as naphthalene, phenanthrene and anthracene; arylene groups from chained polycyclic aromatic hydrocarbons such as biphenyl and terphenyl; besides arylene (phenylene) groups from benzene. Various substituents may be bonded with the arylene group.

Specific examples of the commercially available silicone resins include, but are not limited to, KR251, KR271, KR272, KR282, KR252, KR255, KR152, KR155, KR211, KR216, and KR213 (from Shin-Etsu Chemical Co., Ltd.); and AY42-170, SR2510, SR2400, SR2406, SR2410, SR2405, and SR2411 (from Dow Corning Toray Co., Ltd.).

Among various silicone resins, methyl silicone resins are preferable because they have low toner spent and their charge is less susceptible to environmental fluctuation.

The silicone resin preferably has a weight average molecular weight of 1,000 to 100,000, more preferably 1,000 to 30,000. When the weight average molecular weight is too large, the resulting resin layer may be not uniform because the coating liquid has too large a viscosity. Moreover, the hardened resin layer may have a low density. When the weight average molecular weight is too small, the hardened resin layer may be too brittle.

The resin layer preferably includes the silicone resin in an amount of from 5% to 95% by mass, and more preferably from 10% to 60% by mass, based on total mass of the resins included therein. When not less than 5% by mass, toner spent is improved. When not greater than 95% by mass, the resin layer is tough and not easily abraded.

Specific examples of resins besides the silicone resin having a silanol group and/or a hydrolyzable functional group include, but are not limited to, acrylic resins, amino resins, polyvinyl resins, polystyrene resins, halogenated olefin resins, polyester resins, polycarbonate resins, polyethylene resins, polyvinyl fluoride resins, polyvinylidene fluoride resins, poly(trifluoroethylene) resins, poly (hexafluoropropylene) resins, copolymer of vinylidene fluoride and vinyl fluoride, fluoroterpolymer (e.g., terpolymer of tetrafluoroethylene, vinylidene fluoride, and a non-fluoride monomer), and silicone resins having no silanol group and/or no hydrolyzable group. Two or more of these resins can be used in combination. Among these resins, the acrylic resin is preferably used because of having high adhesiveness to the particulate core material and the electroconductive particulate material and low fragility.

The acrylic resin preferably has a glass transition temperature of from 20° C. to 100° C., and more preferably from 25° C. to 80° C. Such an acrylic resin has suitable elasticity and absorbs an impact due to friction between a toner and a carrier or carriers to the resin layer when a developer is frictionally charged to prevent deterioration of the resin layer and the electroconductive particulate material.

It is preferable that the resin layer components further include a crosslinked material of an acrylic resin and an amino resin, which prevents the resin layers from thermally adhering to each other. Specific example of the amino resin include, but are not limited to, melamine resins and benzoguanamine resins capable of improving chargeability of the carrier. When chargeability of the carrier needs controlling, other amino resins may be used with the melamine resin and/or the benzoguanamine resins.

The acrylic resin capable of crosslinking with the amino resin preferably has a hydroxyl group and/or a carboxyl group, and more preferably has a hydroxyl group. This further improves adhesiveness between the particulate core material and the electroconductive particulate material, and dispersion stability of the electroconductive particulate material. The acrylic resin preferably has a hydroxyl value not less than 10 mg KOH/g, and more preferably not less than 20 mg KOH/g.

In order to accelerate condensation reaction of the crosslinking B component, a titanium catalyst, a tin catalyst, a zirconium catalyst and an aluminum catalyst can be used. Among the titanium catalysts having good effects in these catalysts, titanium alkoxide and titanium chelate are preferably used in particular.

It is thought this is because these effectively accelerate condensation reaction of a silanol group from the crosslinking component B and the catalyst is not easily deactivated. Specific examples of the titanium alkoxide include titanium diisopropoxybis(ethylacetoacetate) having the following formula (II), and specific examples of the titanium chelate include titanium diisopropoxybis(triethanolaminato) having the following formula (III).

$$Ti(O\text{-}i\text{-}C_3H_7)_2(C_6H_9O_3)_2 \quad (II)$$

$$Ti(O\text{-}i\text{-}C_3H_7)_2(C_6H_{14}O_3)_2 \quad (III)$$

The resin layer is formed with a resin layer forming composition including a copolymer including the A component and the B component, and a titanium diisopropoxybis (ethylacetoacetate) catalyst; and a resin besides the copolymer including the A component and the B component, an amino silane coupling agent, fine particles and a solvent when necessary. Specifically, the silanol group may be condensed while or after coating the particulate core material with the solvent including the resin and the catalyst to form the resin layer.

Specific examples of methods of condensing silanol group while coating the particulate core material with the solvent including the resin and the catalyst include, but are not limited to, methods of coating the particulate core material with the solvent including the resin and the catalyst while applying heat or light thereto. Specific examples of methods of condensing silanol group after coating the particulate core material with the solvent including the resin and the catalyst include, but are not limited to, methods of applying heat after coating the particulate core material with the solvent including the resin and the catalyst.

A resin having a large molecular weight typically has high viscosity. When this is coated on a substrate having a small diameter, the particles tend to aggregate and the resin layer tends to be nonuniform. It is quite difficult to coat a carrier.

Therefore, a copolymer resin used in the present invention preferably has a weight-average molecular weight of from 5,000 to 100,000, more preferably from 10,000 to 70,000, and furthermore preferably from 30,000 to 40,000 to assure strength of the resin layer and prevent a liquid from increasing in viscosity and assure good producibility of a carrier.

<<Other Components>>

The resin layer may include other components such as a silane coupling agent besides the above resins and the Al and Sn fine particles.

The resin layer may include a silane coupling agent to stably disperse fine particles.

Specific example of the silane coupling agent include, but are not limited to, amino silane coupling agents such as γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, 3-aminopropylmethyldiethoxysilane and 3-aminopropyltrimethoxysilaene. These can be used alone or in combination.

<Core Particle>

The core particle is not particularly limited as long as it is a magnetic material, and specific examples thereof include electromagnetic materials such as iron and cobalt; iron oxide such as magnetite, hematite and ferrite; various kinds of alloys or compounds; resin particle that these magnetic materials are dispersed in a resin, and the like. Above all, in consideration of environment, Mn ferrite, Mn—Mg ferrite, Mn—Mg—Sr ferrite etc. are preferably used.

<Properties of Carrier>

The carrier of the present invention includes Al and Sn, and a detectable amount of Al is from 1.0% to 12.1% by atom and a ratio (Al/Sn) of the detectable amount of Al to that of Sn is from 2.0 to 50.0 when the carrier is subjected to an X-ray photoelectron spectroscopic (XPS) analysis.

The carrier of the present invention preferably has a volume-average particle diameter of from 20 to 45 μm to prevent magnetization per one particle from decreasing and the carrier from adhering, suppress impact when the carriers collide with each other to decrease stress to convexities on the carrier, prevent fine particles from burying and abrading, and assure sufficient chargeability of the convexities on the carrier to maintain constant charge quantity of a developer in toner spent.

<Methods of Measuring Properties of Carrier>

The properties of the carrier are measured by the following methods.

<<X-Ray Photoelectron Spectroscopic (XPS) Analysis of Al and Sn>>

Amounts of Al and Sn on the surface of the carrier can be measured by AXIS/ULYRA from Shimadzu Corp./KRATOS.

The beam irradiation area is about 900 μm×600 μm to detect a range of 25 pieces×17 pieces of the carrier.

The penetration depth is from 0 to 10 nm to measure near the surface of the carrier.

Specific measuring conditions are:

Measuring Mode: Al: 1486.6 eV

Excitation Source: monochrome (Al)

Detecting Method: Spectrum Mode

Magnet Lens: OFF

A wide scan specifies a detection element and a narrow scan detects a peak of each detection element. Then, % by atom of Al and Sn relative to total detection elements are calculated using an attached peak analysis software.

<<Methods of Measuring Volume-Average Particle Diameter of Carrier>>

The volume-average particle diameter of the carrier can be measured by an SRA type Microtrac particle size analyzer from Nikkiso Co., Ltd. The range is from 0.7 to 125 μm. In Examples, methanol was used as a dispersant. The refractive index of the carrier and the core particle is 2.42.

(Developer)

The developer of the present invention includes at least the carrier and a toner, and other components when necessary.

<Toner>

The toner includes at least a binder resin and a colorant, may be either a monochrome toner or a color toner. The toner may include a release agent in order to be applied to an oilless system where oil for preventing toner from adhering to a fixing roller is not coated. In general, such a toner tends to generate filming, but since the carrier of the present invention can prevent filming, the developer of the present invention can maintain a good quality over a long period of time. Further, color toner, particularly, yellow toner generally has a problem that color smear occurs due to scraping of the coating layer of carrier, but the developer of the present invention can suppress occurrence of color smear.

The toner may include a charge controlling agent, an external additive, a fluidity improver, a cleanability improver, a magnetic material, etc. when necessary.

A toner can be produced using a known method such as grinding technique and polymerization technique. For example, in the case of producing a toner using a grinding technique, first, a melt-kneaded material obtained by kneading toner raw materials is cooled, then, ground and classified to produce a base particle. Next, in order to improve transferability and durability, an external additive is added to the base particle, thereby producing a toner.

Specific examples of the binder resin include, but are not limited to, polymer of styrene and its derivative such as polystyrene, poly(p-styrene) and polyvinyltoluene; a styrene copolymer such as styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer; poly(methyl methacrylate), poly(butyl methacrylate), polyvinylchloride, polyvinyl acetate, polyethylene, polyester, polyurethane, epoxy resin, polyvinyl butyral, poly(acrylic acid), rosin, modified rosin, terpene resin, phenolic resin, aliphatic or aromatic hydrocarbon resin, aromatic petroleum resin, and their combinations Specific examples of the binder resin for pressure-fixing include, but are not limited to, polyolefin such as low-molecular weight polyethylene and low-molecular weight polypropylene; olefin copolymer such as ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer and ionomer resin; epoxy resin, polyester, styrene-butadiene copolymer, polyvinylpyrrolidone, methyl vinyl ether-anhydrous maleic acid copolymer, maleic acid-modified phenolic resin, phenol-modified terpene resin, and their combinations.

Specific examples of the colorant (pigment or dye) include, but are not limited to, and there are listed a yellow pigment such as cadmium yellow, mineral fast yellow, nickel titanium yellow, Naples yellow, naphthol yellow S, Hansa yellow Hansa yellow 10G, benzidine yellow GR, quinoline yellow lake, permanent yellow NCG and tartrazine lake; an orange pigment such as molybdenum orange, permanent orange GTR, pyrazolone orange, Vulcan orange, indanthrene brilliant orange RK, benzidine orange G and indanthrene brilliant orange GK; a red pigment such as iron red, cadmium red, permanent red 4R, lithol red, pyrazolone red, watching red calcium salt, lake red D, brilliant carmine 6B, eosin lake, rhodamine lake B, alizarin lake and brilliant carmine 3B; a violet pigment such as fast violet B and methyl violet lake; a blue pigment such as cobalt blue, alkali blue, Victoria blue lake, phthalocyanine blue, non-metal phthalocyanine blue, phthalocyanine blue-partly chloride, fast sky blue and indanthrene blue BC; a green pigment such as chromium green, chromium oxide, pigment green B and malachite green lake; a black pigment including carbon black, oil furnace black, channel black, lamp black, acetylene black, an azine color such as aniline black, metal salt azo color, metal oxide, complex metal oxide, and their combinations.

Specific examples of the release agent include, but are not limited to, polyolefin such as polyethylene and polypropylene, fatty acid metal salt, fatty acid ester, paraffin wax, amide wax, polyhydric wax, silicone varnish, carnauba wax and ester wax, and their combinations.

(Image Forming Apparatus and Image Forming Method)

The image forming apparatus of the present invention includes at least an electrostatic latent image bearer, an electrostatic latent image former and an image developer, and other means such as a transferer, a fixer, a cleaner, a discharger, a recycler and a controller when necessary.

The image forming method of the present invention includes at least an electrostatic latent image forming process and a development process, and other processes such as a transfer process, a fixing process, a cleaning process, a discharge process, a recycle process and a control process when necessary.

The image forming method of the present invention is preferably performed by the image forming apparatus of the present invention.

More specifically, the image forming apparatus of the present invention includes an electrostatic latent image bearer, an electrostatic latent image former to form an electrostatic latent image on the electrostatic latent image bearer, and an image developer including the developer to develop the electrostatic latent image formed on the electrostatic latent image bearer with the developer to form a toner image.

The electrostatic latent image former may include a charger to charge the electrostatic latent image bearer and an irradiator to irradiate the surface of the electrostatic latent image bearer with imagewise light.

In addition, the image forming apparatus of the present invention may further include a transferer the toner image formed on the electrostatic latent image bearer to a recording medium, a fixer to fix the toner image on the recording medium, and a cleaner to clean the electrostatic latent image bearer.

Various developer containing units containing the developer of the present invention may be used.

The developer containing unit in the present invention is a unit having a capacity of containing the developer.

Embodiments of the developer containing unit include a developer-containing container, an image developer and a process cartridge.

The developer-containing container is a container containing the developer.

The image developer is a means of development, containing the developer.

The process cartridge includes at least an electrostatic latent image bearer and an image developer including the developer of the present invention in a body, which is detachable from an image forming apparatus. The process cartridge may further include one of a charger, an irradiator and a cleaner besides the electrostatic latent image bearer and the image developer in a body.

FIG. 1 is a schematic view illustrating an embodiment of the process cartridge of the present invention. A process cartridge (10) is integrated by a photosensitive body (11), a charging device (12) for charging the photosensitive body (11), a development device (13) for forming a toner image by developing an electrostatic latent image formed on the photosensitive body (11) using a developer of the present invention, and a cleaning device (14) for removing the toner let on photosensitive body (11) after transferring the toner image formed on the photosensitive body (11) to a recording medium, and the process cartridge (10) is detachable to a main body of an image forming device such as facsimile and printer.

Hereinafter, a method for forming an image using an image forming device that a process cartridge (10) is mounted is explained. First, a photosensitive body (11) is driven and rotated at a predetermined circumferential velocity, by a charging device (12), the circumferential surface of photosensitive body (11) is uniformly charged at a predetermined positive or negative potential. Next, from an exposure device (not shown in the figure) such as exposure device of slit exposure system and exposure device of scanning exposure by laser beam, exposure light is irradiated onto the circumferential surface of photosensitive body (11) to form an electrostatic latent image sequentially. Further, the electrostatic latent image formed on the circumferential surface of photosensitive body (11) is developed by a development device (13) using a developer of the present invention to form a toner image. Next, the toner image formed on the circumferential surface of photosensitive body (11) is synchronized with the rotation of photosensitive body (11), and transferred sequentially to a transfer paper fed between the photosensitive body (11) and a transfer device (not shown in the figure) from a paper feeding part (not shown in the figure). Further, the transfer paper that the toner image was transferred is separated from the circumferential surface of photosensitive body (11) and introduced into a fixing device (not shown in the figure) and fixed, then, printed out to the outside of the image forming device as a copy. On the other hand, regarding the surface of photosensitive body (11) after the toner image is transferred, the residual toner is removed for cleanup by a cleaning device (14), then it is discharged by a discharging device (not shown in the figure) to use for image formation repeatedly.

EXAMPLES

Having generally described this invention, further understanding can be obtained by reference to certain specific examples which are provided herein for the purpose of illustration only and are not intended to be limiting. In the descriptions in the following examples, the numbers represent mass ratios in parts, unless otherwise specified.

(Preparation of Core Particle)

A mixture of $MnCO_3$, $Mg(OH)_2$, $Fe_2O_3$ and $SrCO_3$ was pre-burnt at 850° C. for 1 hr in the atmosphere using a heating oven, followed by cooling and pulverization to prepare a powder having a diameter about 3 μm. Water and a dispersant in an amount of 1% by mass were added to the powder to prepare a slurry, and the slurry was fed to a spray dryer to prepare a granulated material having an average particle diameter of 40 μm. The granulated material was placed in a firing furnace and burnt at 1,120° C. for 4 hrs under a nitrogen atmosphere. The burnt material was pulverized by a pulverizer and classified with a sieve to prepare spherical ferrite particles having a volume-average particle diameter about 35 μm.

<Preparation of Fine Particles>

<<Fine Particles 1>>

Aluminum oxide AA03 from Sumitomo Chemical Co., Ltd.

<<Fine Particles 2>>

Aluminum oxide AA05 from Sumitomo Chemical Co., Ltd.

<<Preparation of Fine Particles 3>>

A suspension was prepared by dispersing 100 g of aluminum oxide (AKP-20 from Sumitomo Chemical Co., Ltd.) in 1 liter of water, followed by heating at 65° C. A solution in which 155 g of tin tetrachloride and 4.65 g of phosphorus pentoxide were dissolved in 1 liter of 2N hydrochloric acid and a 12% ammonia water were dropped in the suspension over a period of 3 hrs and 6 min so that pH of the suspension becomes 7 to 8. The suspension was then filtered and washed to obtain a cake. The cake was dried at 110° C. The resulting dried powder was treated at 500° C. for 5 hrs under nitrogen gas flow to prepare electroconductive fine particles 3 having a particle diameter of 600 nm and a volume resistivity of 6 Ω·cm.

<<Preparation of Fine Particles 4>>

After a tin oxide fine powder having a BET surface area of 5 $m^2/g$ and a primary particle diameter of 500 nm was dipped in ethanol, surface-modifying treatment was conducted by heating it under nitrogen atmosphere and maintaining it at 250° C. for 1 hr to obtain electroconductive fine particles 4.

Resin Synthesis Example 1

Three hundred (300) g of toluene were placed in a flask including a stirrer, and heated to have a temperature of 90° C. under nitrogen stream. Next, a mixture of 84.4 g (200 mmol) of 3-methacryloxypropyltris(trimethylsiloxy)silane having a formula of $CH_2{=}CMe\text{-}COO{-}C_3H_6{-}Si(OSiMe_3)_3$ (Me is a methyl group) Silaplane TM-0701T (manufactured by Chisso Corporation), 39 g (150 mmol) of 3-methacryloxypropyltrimethoxysilane, 65.0 g (650 mmol) of methylmethacrylate and 0.58 g (3 mmol) of 2,2'-azobis-2-methylbutyronitrile was dropped therein for 1 hour. Further, a solution in which 0.06 g (0.3 mmol) of 2,2'-azobis-2-methylbutyronitrile was dissolved in 15 g of toluene was added, then, mixed at 90° C. to 100° C. for 3 hours such that radical copolymerization is performed to prepare a methacrylic copolymer 1.

The methacrylic copolymer 1 had a weight-average molecular weight of 33,000. A solution of the methacrylic copolymer 1 was diluted with toluene to have a nonvolatile component of 24% by mass. The copolymer solution had a viscosity of 8.8 $mm^2/sec$ and a specific gravity of 0.91.

The weight-average molecular weight was determined from standard polyester conversion using gel permeation chromatography. The viscosity was measured according to JIS-K-2283 at 25° C. The nonvolatile component was determined by the following formula, weighing 1 g of the coating composition on an aluminum plate and heating the composition at 150° C. for 1 hr.

Nonvolatile component (%)=(mass before heated−mass after heated)×100/mass before heated

Toner Preparation Example 1

<<Toner 1>>

—Synthesis of Polyester Resin A—

65 parts of an adduct of bisphenol A with 2 moles of ethyleneoxide, 86 parts of an adduct of bisphenol A with 3 moles of propyleneoxide, 274 parts terephthalic acid and 2 parts of dibutyltinoxide were mixed and reacted in a reactor vessel including a cooling pipe, a stirrer and a nitrogen inlet pipe for at 230° C. for 15 hrs under a normal pressure. Next, the mixture was reacted for 6 hrs under reduced pressure of from 10 to 15 mm Hg to prepare a polyester resin A. The polyester resin A had a number-average molecular weight (Mn) of 2,300, a weight-average molecular weight (Mw) of 8,000, a glass transition temperature (Tg) of 58° C., an acid value of 25 mg KOH/g and a hydroxyl value of 35 mg KOH/g.

—Synthesis of Styrene-Acrylic Resin A—

Three hundred (300) parts of ethylacetate, 185 parts of styrene, 115 parts of an acrylic monomer and 5 parts of azobisisobutylnitrile were mixed and reacted in a reactor vessel including a cooling pipe, a stirrer and a nitrogen inlet pipe for at 65° C. for 8 hrs in a nitrogen atmosphere under a normal pressure. Next, after 200 parts of methanol was added and the mixture was stirred for 1 hr, a supernatant was removed therefrom and the mixture was dried under reduced pressure to prepare a styrene-acrylic resin A having a Mw of 20,000 and a Tg of 58° C.

—Synthesis of Prepolymer (Polymer Reactable with Compound Including Active Hydrogen Group)—

682 parts of an adduct of bisphenol A with 2 moles of ethyleneoxide, 81 parts of an adduct of bisphenol A with 2 moles of propyleneoxide, 283 parts terephthalic acid, 22 parts of terephthalic acid anhydride and 2 parts of dibutyltinoxide were mixed and reacted in a reactor vessel including a cooling pipe, a stirrer and a nitrogen inlet pipe for at 230° C. for 8 hrs under a normal pressure. Next, the mixture was reacted for 5 hrs under reduced pressure of from 10 to 15 mm Hg to prepare an intermediate polyester.

The intermediate polyester had a number-average molecular weight (Mn) of 2,100, a weight-average molecular weight (Mw) of 9,600, a glass transition temperature (Tg) of 55° C., an acid value of 0.5 mg KOH/g and a hydroxyl value of 49 mg KOH/g.

Next, 411 parts of the intermediate polyester, 89 parts of isophoronediisocyanate and 500 parts of ethyl acetate were reacted in a reactor vessel including a cooling pipe, a stirrer and a nitrogen inlet pipe for 5 hrs at 100° C. to prepare a prepolymer (a polymer reactable with a compound including an active hydrogen group).

The prepolymer included a free isocyanate in an amount of 1.60% by mass and had a solid content concentration of 50% by mass after left for 45 min at 150° C.

—Synthesis of Ketimine (the Compound Including an Active Hydrogen Group)—

Thirty (30) parts of isophoronediamine and 70 parts of methyl ethyl ketone were reacted at 50° C. for 5 hrs in a reaction vessel including a stirrer and a thermometer to prepare a ketimine compound. The ketimine compound (the compound including an active hydrogen group) had an amine value of 423 mg KOH/g.

—Preparation of Masterbatch—

One thousand (1,000) parts of water, 540 parts of carbon black PRINTEX 35 from Degussa A. G. having a DBP oil absorption of 42 ml/100 mg and a pH of 9.5, 1,200 parts of the polyester resin A were mixed by a Henschel mixer from Mitsui Mining Co., Ltd. After the mixture was kneaded by a two-roll mill having a surface temperature of 150° C. for 30 min, the mixture was extended by applying pressure, cooled and pulverized by a pulverizer from Hosokawa Micron Limited to prepare a masterbatch.

—Preparation of Aqueous Medium—

Three hundred and six (306) parts of ion-exchanged water, 265 parts of a suspension liquid of tricalcium phosphate having a concentration of 10% by mass and 1.0 part of sodium dodecyldiphenyletherdisulfonate were mixed, stirred and uniformly dissolved to prepare an aqueous medium.

—Measurement of Critical Micelle—

A critical micelle concentration of a surfactant was measured as follows. An analysis was made using an analysis program in a surface tensiometer Sigma from KSV Instruments. A surfactant was dropped 0.01% by 0.01% by mass in the aqueous medium, and the surface tension after stirred and left was measured. From the obtained surface tension curve, a concentration of the surfactant at which the interface tension did not lower even when the surfactant is dropped in was determined as a critical micelle concentration. The sodium dodecyldiphenyletherdisulfonate had a critical micellar concentration of 0.05% by mass based on total weight of the aqueous medium when measured by the surface tensiometer Sigma.

—Preparation of Toner Materials Liquid—

Seventy (70) parts of the polyester resin A, 10 parts of the prepolymer and 100 parts of ethylacetate were stirred and dissolved in a beaker to prepare a solution. Five (5) parts of a paraffin wax (HNP-9 having a melting point of 75° C. from Nippon Seiro Co., Ltd.) as a release agent, 2 parts of MEK-ST (from Nissan Chemical Industries, Ltd.) and 10 parts of the masterbatch were added to the solution and the solution was dispersed by a beads mill (Ultra Visco Mill from IMECS CO., LTD.) for 3 passes under the following conditions:

liquid feeding speed of 1 kg/hr;

peripheral disc speed of 6 m/sec; and filling zirconia beads having diameter of 0.5 mm for 80% by volume to prepare a dispersion.

Then, 2.7 parts of the ketimine were added to the dispersion to prepare a toner materials liquid.

—Preparation of Emulsion or Dispersion—

One hundred fifty (150) parts of the aqueous medium were placed in a container and stirred by TK-type homomixer from Tokushu Kika Kogyo Co., Ltd. at 12,000 rpm, and 100 parts of the toner materials liquid were added in the aqueous medium and mixed therein for 10 min thereby to prepare an emulsion or dispersion (an emulsified slurry).

—Removal of Organic Solvent—

One hundred (100) parts of the emulsified slurry were placed in a flask with a stirrer and a thermometer and de-solvented at 30° C. for 12 hrs while stirred at a stirring peripheral speed of 20 m/min.

—Washing—

After 100 parts of the dispersion slurry was filtered under reduced pressure, 100 parts of ion-exchange water were added to the filtered cake and mixed by TK-type homomixer at 12,000 rpm for 10 min, and the mixture was filtered. Three hundred (300) parts of ion-exchanged water were added to the filtered cake and mixed by the TK-type homomixer at 12,000 rpm for 10 min, and the mixture was filtered, which was repeated again. Twenty (20) parts of an aqueous solution of 10% sodium hydrate were added to the filtered cake and mixed by the TK-type homomixer at 12,000 rpm for 10 min, and the mixture was filtered under reduced pressure. Three hundred (300) parts of ion-exchanged water were added to the filtered cake and mixed by the TK-type homomixer at 12,000 rpm for 10 min, and the mixture was filtered. Three hundred (300) parts of ion-exchanged water were added to the filtered cake and mixed by the TK-type homomixer at 12,000 rpm for 10 min, and the mixture was filtered, which was repeated again. Further, 20 parts of 10% hydrochloric acid were added to the filtered cake and mixed by the TK-type homomixer at 12,000 rpm for 10 min, and the mixture was filtered.

—Surfactant Adjustment—

An electroconductivity of the toner dispersion when 300 parts of ion-exchanged water were added to the filtered cake and mixed by the TK-type homomixer at 12,000 rpm for 10 min was measured to calculate a surfactant concentration in the toner dispersion from a calibration curve of the surfactant concentration prepared in advance. Ion-exchanged water was added such that the surfactant concentration is a desired 0.05% by mass to obtain the toner dispersion.

—Surface Treatment—

The toner dispersion having a predetermined surfactant concentration was heated in a water bath at 55° C. (=T1) for 10 hrs while mixed by the TK-type homomixer at 5,000 rpm.

Then, the toner dispersion was cooled to have a temperature of 25° C. and filtered. Three hundred (300) parts of ion-exchanged water were added to the filtered cake and mixed by the TK-type homomixer at 12,000 rpm for 10 min, and the mixture was filtered.

—Drying—

The final filtered cake was dried by an air drier at 45° C. for 48 hrs and sieved by a mesh having an opening of 75 μm to prepare a base toner particle.

—Adding External Additive—

One hundred (100) parts of the base toner particle, 0.3 parts of hydrophobic silica having an average particle diameter of 100 nm and 0.5 parts of hydrophobized titanium oxide having an average particle diameter of 20 nm and 1.5 parts of a fine powder of hydrophobic silica were mixed by a HENSCHEL MIXER to prepare a toner 1.

Example 1

The following materials except for a titanium catalyst were dispersed by a paint shaker for 1 hr together with 1,000 parts of 0.5 mm Zr beads, and the beads were removed by a mesh and the dispersion was left for 10 min to prepare a solution of resin layer composition.

| | |
|---|---|
| Methacrylic copolymer 1 (including a solid content of 24% by mass) | 22.0 |
| Silicone resin solution (SR2410 including a solid content of 41% by mass from Dow Corning Toray Silicone Co., Ltd.) | 217 |
| Titanium catalyst (TC-754 including a solid content of 57% by mass from Matsumoto Fine Chemical Co., Ltd.) | 23.2 |
| Aminosilane (SH6020 including a solid content of 100% by mass from Dow Corning Toray Silicone Co., Ltd.) | 3.6 |
| Fine particles 1 | 17 |
| Fine particles 4 | 27 |
| IP solvent (from Idemitsu Kosan Co., Ltd.) | 1,260 |

After the above materials except for the titanium catalyst were dispersed in a paint shaker for 1 hr with 1,000 parts of 0.5 mm Zr beads, the beads were removed from the dispersion and the dispersion was left for 10 min to prepare a solution of resin layer composition. On 5,000 parts by mass of a burnt ferrite powder having an average particle diameter of 35 μm and a true specific gravity of 5.5 as a core particle, the solution of resin layer composition the titanium catalyst was added to was coated by SPIRA COTA (from Okada Seiko Co., Ltd.) at a an inner temperature of 60° C. and dried. The resultant carrier was burnt in an electric oven at 210° C. for 1 hr. After cooled, the ferrite powder bulk was sieved through openings of 63 μm to prepare a carrier 1 having a volume-average particle diameter of 36 μm. Ratios of the fine particles 1 and 4 were 13.4% and 19.7% by mass, respectively based on total mass of solid contents included in the resin layer.

The carrier 1 and the toner 1 were mixed by a turbular mixer at 81 rpm for 5 min to prepare a developer 1 having a toner concentration of 7% by mass.

Al and Sn detectable amounts of the carrier 1 and the developer 1 were measured by the above XPS method. The results are shown in Table 1.

When the Al and Sn detectable amounts were measured, the state of the developer after producing images for a long time was made as follows. The carrier and the toner were mixed in an environment of 30° C. and 90% RH to form a developer having a toner concentration of 20% by mass. Seven (7.0) g of the developer was stirred by a magroll including a 500 G magnet at 500 rpm for 2 hrs.

Example 2

The procedures for preparations of the carrier 1 and the developer 1 in Example 1 were repeated except for changing the contents of the fine particles 1 and 4 into 145.0 and 46.0 parts, respectively to prepare a carrier 2 having a volume-average particle diameter of 35 μm and a developer 2. Percentages by mass of the fine particles 1 and 4 to total mass of solid contents included in the resin layer of the carrier 2 are shown in Table 1.

Example 3

The procedures for preparations of the carrier 1 and the developer 1 in Example 1 were repeated except for changing the contents of the fine particles 1 and 4 into 41.0 and 38.0 parts, respectively to prepare a carrier 3 having a volume-average particle diameter of 35 μm and a developer 3. Percentages by mass of the fine particles 1 and 4 to total mass of solid contents included in the resin layer of the carrier 3 are shown in Table 1.

Example 4

The procedures for preparations of the carrier 1 and the developer 1 in Example 1 were repeated except for changing the contents of the fine particles 1 and 4 into 44.0 and 38.0 parts, respectively to prepare a carrier 4 having a volume-average particle diameter of 35 μm and a developer 4. Percentages by mass of the fine particles 1 and 4 to total mass of solid contents included in the resin layer of the carrier 4 are shown in Table 1.

Example 5

The procedures for preparations of the carrier 1 and the developer 1 in Example 1 were repeated except for changing the contents of the fine particles 1 and 4 into 140.0 and 15.0 parts, respectively to prepare a carrier 5 having a volume-average particle diameter of 36 μm and a developer 5. Percentages by mass of the fine particles 1 and 4 to total mass of solid contents included in the resin layer of the carrier 5 are shown in Table 1.

Example 6

The procedures for preparations of the carrier 1 and the developer 1 in Example 1 were repeated except for changing the contents of the fine particles 1 and 4 into 148.0 and 15.0 parts, respectively to prepare a carrier 6 having a volume-average particle diameter of 35 μm and a developer 6. Percentages by mass of the fine particles 1 and 4 to total mass of solid contents included in the resin layer of the carrier 6 are shown in Table 1.

Example 7

The procedures for preparations of the carrier 1 and the developer 1 in Example 1 were repeated except for changing the contents of the fine particles 1 and 4 into 125.0 and 20.0 parts, respectively to prepare a carrier 7 having a volume-average particle diameter of 35 μm and a developer 7. Percentages by mass of the fine particles 1 and 4 to total mass of solid contents included in the resin layer of the carrier 7 are shown in Table 1.

Example 8

The procedures for preparations of the carrier 1 and the developer 1 in Example 1 were repeated except for changing the contents of the fine particles 1 and 4 into 115.0 and 20.0 parts, respectively to prepare a carrier 8 having a volume-average particle diameter of 35 μm and a developer 8. Percentages by mass of the fine particles 1 and 4 to total mass of solid contents included in the resin layer of the carrier 8 are shown in Table 1.

Example 9

The procedures for preparations of the carrier 1 and the developer 1 in Example 1 were repeated except for changing the contents of the fine particles 1 and 4 into 310.0 and 47.0 parts, respectively to prepare a carrier 9 having a volume-average particle diameter of 36 μm and a developer 9. Percentages by mass of the fine particles 1 and 4 to total mass of solid contents included in the resin layer of the carrier 9 are shown in Table 1.

Example 10

The procedures for preparations of the carrier 1 and the developer 1 in Example 1 were repeated except for changing the contents of the fine particles 1 and 4 into 280.0 and 35.0 parts, respectively to prepare a carrier 10 having a volume-average particle diameter of 35 μm and a developer 10. Percentages by mass of the fine particles 1 and 4 to total mass of solid contents included in the resin layer of the carrier 10 are shown in Table 1.

Example 11

The procedures for preparations of the carrier 1 and the developer 1 in Example 1 were repeated except for changing the contents of the fine particles 1 and 4 into 108.0 and 15.0 parts, respectively to prepare a carrier 11 having a volume-average particle diameter of 35 μm and a developer 11. Percentages by mass of the fine particles 1 and 4 to total mass of solid contents included in the resin layer of the carrier 11 are shown in Table 1.

Example 12

The procedures for preparations of the carrier 1 and the developer 1 in Example 1 were repeated except for changing the contents of the fine particles 1 and 4 into 115.0 and 15.0 parts, respectively to prepare a carrier 12 having a volume-average particle diameter of 35 μm and a developer 12. Percentages by mass of the fine particles 1 and 4 to total mass of solid contents included in the resin layer of the carrier 12 are shown in Table 1.

Example 13

The procedures for preparations of the carrier 1 and the developer 1 in Example 1 were repeated except for changing the contents of the fine particles 1 and 4 into 180.0 and 20.0 parts, respectively to prepare a carrier 13 having a volume-average particle diameter of 35 μm and a developer 13. Percentages by mass of the fine particles 1 and 4 to total mass of solid contents included in the resin layer of the carrier 13 are shown in Table 1.

Example 14

The procedures for preparations of the carrier 1 and the developer 1 in Example 1 were repeated except for replacing the fine particles 1 with the fine particles 2 to prepare a carrier 14 having a volume-average particle diameter of 36 μm and a developer 14. Percentages by mass of the fine particles 1 and 4 to total mass of solid contents included in the resin layer of the carrier 14 are shown in Table 1.

Example 15

The procedures for preparations of the carrier 14 and the developer 14 in Example 14 were repeated except for changing the contents of the fine particles 1 and 4 into 145.0 and 46.0 parts, respectively to prepare a carrier 15 having a volume-average particle diameter of 36 μm and a developer 15. Percentages by mass of the fine particles 1 and 4 to total mass of solid contents included in the resin layer of the carrier 15 are shown in Table 1.

Example 16

The procedures for preparations of the carrier 1 and the developer 1 in Example 1 were repeated except for changing the contents of the fine particles 1 and 4 into 350.0 and 12.0 parts, respectively to prepare a carrier 16 having a volume-average particle diameter of 35 μm and a developer 16. Percentages by mass of the fine particles 1 and 4 to total mass of solid contents included in the resin layer of the carrier 16 are shown in Table 1.

Comparative Example 1

The procedures for preparations of the carrier 1 and the developer 1 in Example 1 were repeated except for changing the contents of the fine particles 1 and 4 into 11.0 and 27.0 parts, respectively to prepare a comparative carrier 1 having a volume-average particle diameter of 35 μm and a comparative developer 1. Percentages by mass of the fine particles 1 and 4 to total mass of solid contents included in the resin layer of the comparative carrier 1 are shown in Table 1.

Comparative Example 2

The procedures for preparations of the carrier 1 and the developer 1 in Example 1 were repeated except for changing the contents of the fine particles 1 and 4 into 145.0 and 50.0 parts, respectively to prepare a comparative carrier 2 having a volume-average particle diameter of 35 μm and a comparative developer 2. Percentages by mass of the fine particles 1 and 4 to total mass of solid contents included in the resin layer of the comparative carrier 2 are shown in Table 1.

Comparative Example 3

The procedures for preparations of the carrier 1 and the developer 1 in Example 1 were repeated except for replacing the fine particles 1 and 4 with 64.0 parts of the fine particles 3 to prepare a comparative carrier 3 having a volume-average particle diameter of 35 μm and a comparative developer 3. Percentages by mass of the fine particles 3 to total mass of solid contents included in the resin layer of the comparative carrier 3 are shown in Table 1.

Comparative Example 4

The procedures for preparations of the carrier 1 and the developer 1 in Example 1 were repeated except for changing the contents of the fine particles 1 and 4 into 360.0 and 45.0 parts, respectively to prepare a comparative carrier 4 having a volume-average particle diameter of 35 μm and a comparative developer 4. Percentages by mass of the fine particles 1 and 4 to total mass of solid contents included in the resin layer of the comparative carrier 4 are shown in Table 1.

Comparative Example 5

The procedures for preparations of the carrier 1 and the developer 1 in Example 1 were repeated except for changing the contents of the fine particles 1 and 4 into 130.0 and 12.0 parts, respectively to prepare a comparative carrier 5 having a volume-average particle diameter of 35 μm and a comparative developer 5. Percentages by mass of the fine particles 1 and 4 to total mass of solid contents included in the resin layer of the comparative carrier 5 are shown in Table 1.

TABLE 1

| | Carrier | Developer | Al fine particles | | Sn fine particles | |
|---|---|---|---|---|---|---|
| | No. | No. | No. | Mass % | No. | Mass % |
| Example 1 | 1 | 1 | 1 | 13.4 | 4 | 19.7 |
| Example 2 | 2 | 2 | 1 | 56.8 | 4 | 29.4 |
| Example 3 | 3 | 3 | 1 | 27.1 | 4 | 25.6 |
| Example 4 | 4 | 4 | 1 | 28.5 | 4 | 25.6 |
| Example 5 | 5 | 5 | 1 | 55.9 | 4 | 12.0 |
| Example 6 | 6 | 6 | 1 | 57.3 | 4 | 12.0 |
| Example 7 | 7 | 7 | 1 | 53.1 | 4 | 15.3 |
| Example 8 | 8 | 8 | 1 | 51.0 | 4 | 15.3 |
| Example 9 | 9 | 9 | 1 | 73.8 | 4 | 29.9 |
| Example 10 | 10 | 10 | 1 | 71.7 | 4 | 24.1 |
| Example 11 | 11 | 11 | 1 | 49.5 | 4 | 12.0 |
| Example 12 | 12 | 12 | 1 | 51.0 | 4 | 12.0 |
| Example 13 | 13 | 13 | 1 | 62.0 | 4 | 15.3 |
| Example 14 | 14 | 14 | 2 | 13.4 | 4 | 19.7 |
| Example 15 | 15 | 15 | 2 | 56.8 | 4 | 29.4 |
| Example 16 | 16 | 16 | 1 | 76.0 | 4 | 9.8 |
| Comparative Example 1 | Comparative 1 | Comparative 1 | 1 | 9.1 | 4 | 19.7 |
| Comparative Example 2 | Comparative 2 | Comparative 2 | 1 | 56.8 | 4 | 31.2 |
| Comparative Example 3 | Comparative 3 | Comparative 3 | 3 | 36.7 | — | — |
| Comparative Example 4 | Comparative 4 | Comparative 4 | 1 | 76.5 | 4 | 29.0 |
| Comparative Example 5 | Comparative 5 | Comparative 5 | 1 | 54.1 | 4 | 9.8 |

| | Carrier No. | Developer No. | Al detectable amount | | Al/Sn detectable amount ratio | |
|---|---|---|---|---|---|---|
| | | | Initial (atomic %) | After long-run | Initial | After long-run |
| Example 1 | 1 | 1 | 1.1 | 2.6 | 2.1 | 1.0 |
| Example 2 | 2 | 2 | 2.5 | 9.6 | 2.1 | 2.7 |
| Example 3 | 3 | 3 | 1.9 | 3.9 | 2.1 | 1.3 |
| Example 4 | 4 | 4 | 2.0 | 4.1 | 2.3 | 1.3 |
| Example 5 | 5 | 5 | 5.3 | 9.3 | 46.3 | 4.9 |
| Example 6 | 6 | 6 | 5.6 | 9.7 | 48.7 | 5.1 |
| Example 7 | 7 | 7 | 4.8 | 8.5 | 16.8 | 3.9 |
| Example 8 | 8 | 8 | 4.4 | 7.9 | 15.6 | 3.7 |
| Example 9 | 9 | 9 | 11.1 | 18.5 | 9.2 | 5.1 |
| Example 10 | 10 | 10 | 10.0 | 16.8 | 12.6 | 5.7 |
| Example 11 | 11 | 11 | 4.2 | 7.6 | 36.8 | 4.0 |
| Example 12 | 12 | 12 | 4.4 | 7.9 | 38.9 | 4.2 |
| Example 13 | 13 | 13 | 6.6 | 11.4 | 23.4 | 5.3 |
| Example 14 | 14 | 14 | 1.3 | 2.6 | 2.5 | 1.0 |
| Example 15 | 15 | 15 | 2.9 | 9.6 | 2.5 | 2.7 |
| Example 16 | 16 | 16 | 12.1 | 20.6 | 19.4 | 11.9 |
| Comparative Example 1 | Comparative 1 | Comparative 1 | 0.9 | 2.3 | 1.7 | 0.9 |
| Comparative Example 2 | Comparative 2 | Comparative 2 | 2.5 | 9.6 | 1.9 | 2.5 |
| Comparative Example 3 | Comparative 3 | Comparative 3 | 0.1 | 0.5 | 0.13 | 0.4 |

TABLE 1-continued

| | | | | | | |
|---|---|---|---|---|---|---|
| Comparative Example 4 | Comparative 4 | Comparative 4 | 12.8 | 21.2 | 11.3 | 6.0 |
| Comparative Example 5 | Comparative 5 | Comparative 5 | 4.9 | 8.7 | 411.7 | 5.0 |

Having now fully described the invention, it will be apparent to one of ordinary skill in the art that many changes and modifications can be made thereto without departing from the spirit and scope of the invention as set forth therein.

What is claimed is:

1. A carrier, comprising:

a magnetic core particle, and a resin layer comprising resin, Al, and Sn and covering a surface of the magnetic core particle, wherein the carrier has a detectable amount of Al of from 1.0% to 12.1% by atom, and a ratio (Al/Sn) of the detectable amount of Al to a detectable amount of Sn of from 4.3 to 50.0, as determined by X-ray photoelectron spectroscopic (XPS) analysis of said carrier, wherein the Al in the resin layer is present as Al particles, and a content of the Al particles in the resin layer is from 12% to 76% by mass based on total mass of the resin in the resin layer, and wherein the Sn present in the resin layer is present as Sn particles.

2. The carrier of claim 1, wherein said carrier, after being removed from a mixture of said carrier and 20% by mass of a toner based on the total mass of the carrier and the toner prepared by mixing at 500 rpm for 2 hrs at 30° C. and 90% relative humidity, has a detectable amount of Al of from 9.5% to 20.0% by atom as determined by XPS analysis.

3. The carrier of claim 1, wherein said carrier, after being removed from a mixture of said carrier and 20% by mass of a toner based on the total mass of the carrier and the toner prepared by mixing at 500 rpm for 2 hrs at 30° C. and 90% relative humidity, has a ratio (Al/Sn) of from 5.0 to 11.0 as determined by XPS analysis.

4. The carrier of claim 1, wherein the content of the Al particles in the resin layer is from 52% to 76% by mass based on total mass of the resin in the resin layer.

5. The carrier of claim 1, wherein the ratio (Al/Sn) of the detectable amount of Al to the detectable amount of Sn is from 9.2 to 48.7.

6. A developer, comprising;

the carrier according to claim 1; and a toner.

7. An image forming apparatus, comprising:

an electrostatic latent image bearer;

an electrostatic image former to form an electrostatic latent image on the electrostatic latent image bearer; and an image developer comprising the developer according to claim 6.

8. A developer container unit containing the developer according to claim 6.

9. The carrier of claim 1, wherein the Al particles are aluminum oxide particles.

10. The carrier of claim 9, wherein the Sn particles are tin oxide particles or particles of tin oxide doped with phosphorus.

11. The carrier of claim 1, wherein the resin layer has an average thickness of from 0.30 to 0.90 μm.

12. The carrier of claim 1, wherein the resin is a copolymer comprising the following A component and B component:

A component

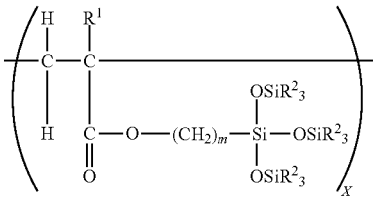

B component

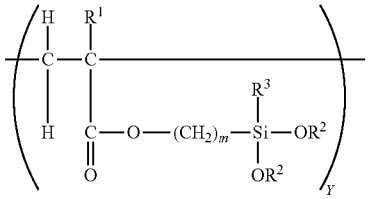

wherein $R^1$ represents a hydrogen atom or a methyl group; m represents an integer of from 1 to 8; $R^2$ represents an alkyl having 1 to 4 carbon atoms; $R^3$ represents an alkyl group having 1 to 8 carbon atoms or an alkoxy group having 1 to 4 carbon atoms; X is from 10% to 90% by mol; and Y is from 10% to 90% by mol.

13. The carrier of claim 12, wherein X is from 10% to 40% by mol, and Y is from 10% to 80% by mol.

14. The carrier of claim 12, wherein the Sn particles are tin oxide particles or particles of tin oxide doped with phosphorus, and the Al particles are aluminum oxide particles.

* * * * *